United States Patent [19]

Braun et al.

[11] Patent Number: 4,645,265

[45] Date of Patent: Feb. 24, 1987

[54] ROLLER CUTTER LOADER FOR MINE

[75] Inventors: Gert Braun; Ernst Braun, both of Essen-Heisingen, Fed. Rep. of Germany

[73] Assignee: Halbach & Braun Industrieanlagen, Fed. Rep. of Germany

[21] Appl. No.: 805,431

[22] Filed: Dec. 5, 1985

[30] Foreign Application Priority Data

Dec. 8, 1984 [DE] Fed. Rep. of Germany ..... 3444845

[51] Int. Cl.[4] ..... E21C 27/34

[52] U.S. Cl. ..... 299/45; 299/34

[58] Field of Search ..... 299/45, 43, 34

[56] References Cited

U.S. PATENT DOCUMENTS

| | | | |
|---|---|---|---|
| 3,378,306 | 4/1968 | Lobbe | 299/34 |
| 4,185,876 | 1/1980 | Pentith | 299/45 |

FOREIGN PATENT DOCUMENTS

| | | | |
|---|---|---|---|
| 280699 | 12/1964 | Netherlands | 299/34 |
| 2072237 | 9/1981 | United Kingdom | 299/34 |
| 2093504 | 9/1982 | United Kingdom | 299/43 |
| 2125857 | 3/1984 | United Kingdom | 299/43 |

*Primary Examiner*—Stephen J. Novosad
*Assistant Examiner*—Michael A. Goodwin
*Attorney, Agent, or Firm*—McGlew and Tuttle

[57] ABSTRACT

A roll cutter loader is guided on a plane guide and has a machine frame with cutter rolls pulled by a plane chain. The machine frame is subdivided into two machine joint elements each with a cutter roll and roll drive assembly. The two machine joint elements are lower in structural height than the cutter rolls and are adjustably connected together relative to the floor, on the one hand via a joint and on the other hand via a setting device. In this way maneuverable, adaptable and compact construction is achieved, so that the roll cutter loader can be used to mine low mineral lodes.

14 Claims, 3 Drawing Figures

FIG. 1
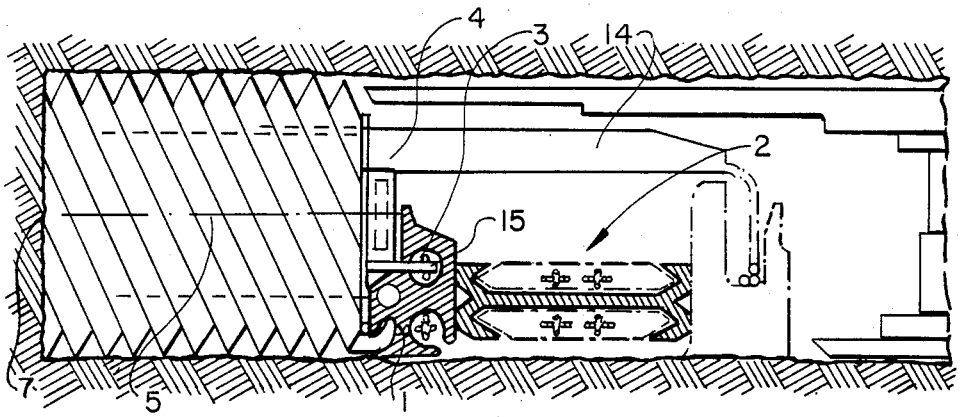
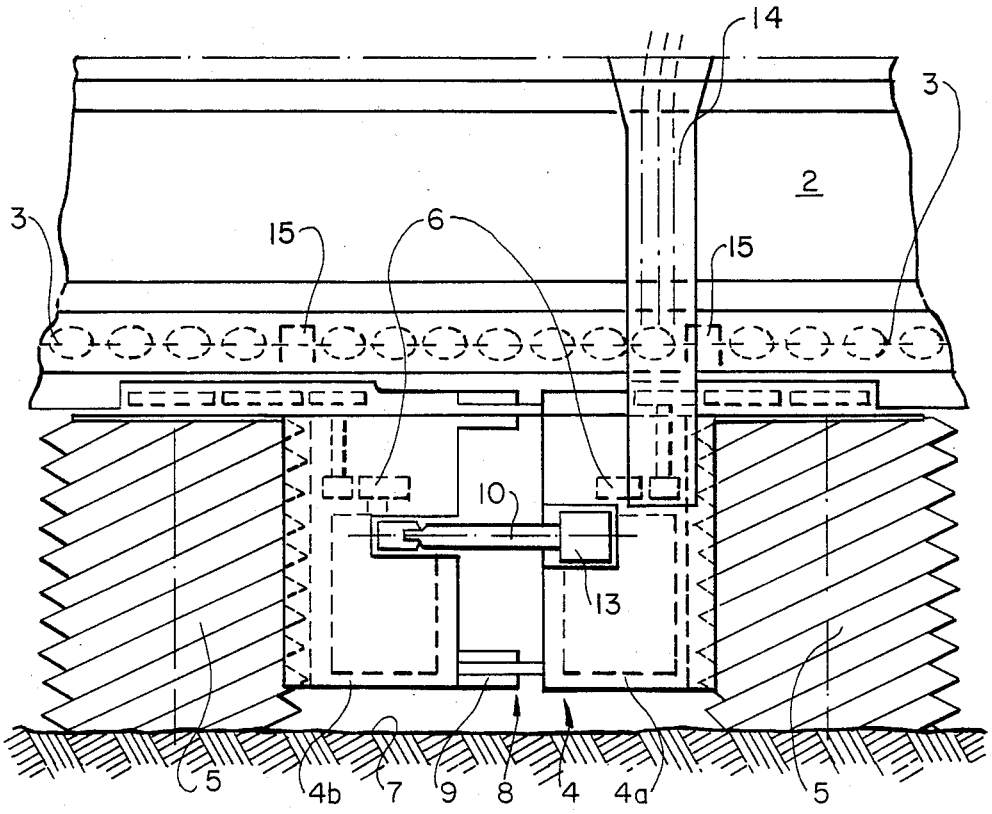
FIG. 2

ROLLER CUTTER LOADER FOR MINE

FIELD AND BACKGROUND OF THE INVENTION

The present invention relates in general to mining equipment and in particular to a new and useful roll cutter loader with a machine frame guided at a plane guide on a longwall conveyor and pulled by a plane chain and having end side cutting rolls mounted on the machine frame and roll drive assemblies accommodated in the machine frame, the cutting rolls working in the region between the plane guide and the working face of a mine.

Such roll cutter loaders are known, which comprise a rigid machine frame with pivotably mounted roll supporting arms for the cutter rolls. The machine frame requires a relatively large space and does not permit adaptation to the mineral lode. In particular the frame does not permit a flexible run through depressions and anticlines. In addition, such roll cutter loaders are not very suitable for use in thin lodes because of their structural height. This is true also for coal planes when the lode narrows and a uniform lode opening is to be achieved. A coal plane is also generally not suitable for cutting through obstacles or faults. Instead the use of a roll cutter loader is advisable, but only in a flexible and compact model. This is where the present invention comes in.

SUMMARY OF THE INVENTION

It is the object of the invention to provide a roll cutter loader which excels in adaptability to the lode, which has a compact construction and which is suitable for use in low lodes, especially when obstacles are to be cut through and uniform lode openings are to be obtained.

The roll cutter loader of the present invention solves the aforementioned problems in that the machine frame is divided into two machine joint elements, each having a cutter roll and a roll drive assembly, and that the two machine joint elements have a lower structural height than the cutter rolls and are connected together adjustable, relative to the floor or roof, on the one hand, via at least one joint with horizontal joint axle, and, on the other hand, via at least one setting device. The roll cutter loader according to the invention is thus of relatively short and low construction, consisting essentially of only two loader halves or units which are connected together via the horizontal joint axle and the control device in such a way that a tilt control is realized for adaptation to different lodes and in particular when running through depressions and anticlines or saddles of the long wall. Actually the roll cutter loader according to the invention is relatively maneuverable and can be used even in steep stratification. The machine which is divided into two machine joint elements is designed as a cantilevered construction, dispensing with a machine carriage, and its bracing against the floor occurs essentially via skids and the plane guide, which is designed as a plane joint guide.

Additional features which are essential to the invention are enumerated in the following: The invention provides that in the region of their floorfree underside, the machine joint elements are connected together via two identical joints with joint axles aligned at right angles to the machine movement direction and, in the region of their top side, via the setting device. The setting device, therefore, is easily accessible and permits any desired angular adjustments between the machine joint elements that are articulatedly connected together and the cutter rolls supported thereby. Appropriately each machine joint element is connectable to the plane chain separately and is additionally braced against the floor by means of pivotably mounted skids. According to the invention, the skids are mounted at an end of the machine joint elements near the rolls, a scraper edge being associated with the cutter rolls. The scraping effect resulting therefrom makes it possible for the floor to be evened out. Furthermore, the skids assume a teeter or seesaw function for the control of the cutter rolls in conjunction with the setting device, so that the cutter rolls can move up or down. Further the invention provides that the plane chain and the skids are connected to the machine joint elements at the center-of-gravity planes of the loader halves, to facilitate the displacing of the roll cutter loader of the invention at the plane guide. The term loader halves as used here means the machine joint elements with the roll drive assemblies and their cutter rolls. The setting device may be designed in a simple manner as a setting spindle with drive by electric motor or else as a cylinder-piston arrangement to be operated pneumatically or hydraulically, and is connected to both machine joint elements in an articulated and centered manner. It suffices if only one of the two machine joint elements has an energy supply gantry bridging the longwall conveyor.

The advantages achieved by the invention are seen essentially in that a roll cutter loader for displacement at the plane guide of a longwall conveyor is realized which excels in performance due to its compact and maneuverable construction. Consequently, the inventive roll cutter can be used in low lodes under 1.50 m to 0.76 m when, for example, a coal plane is no longer suitable because of narrowing of the lode and a uniform lode opening is to be obtained. The same is true for the cutting or holing through of obstacles or faults, for example in case of throws of rock formation and coal. In addition, the new roll cutter loader excels by its adaptability to the particular lay of the lode as well as to depressions and anticlines to be traversed. The roll cutter loader according to the invention is also easy to pull out of the longwall in case of operational disturbances or malfunctions, for repairs.

A further object of the invention is to provide a roll cutter loader which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, the invention will be explained more specifically with reference to the drawings which illustrates one embodiment and in which:

FIG. 1 is a schematic front elevational view of a roll cutter loader according to the invention, with the plane guide shown in section;

FIG. 2 is a top plan view of the device according to FIG. 1; and

DESCRIPTION OF THE PREFERRED EMBODIMENT

Figure 3:
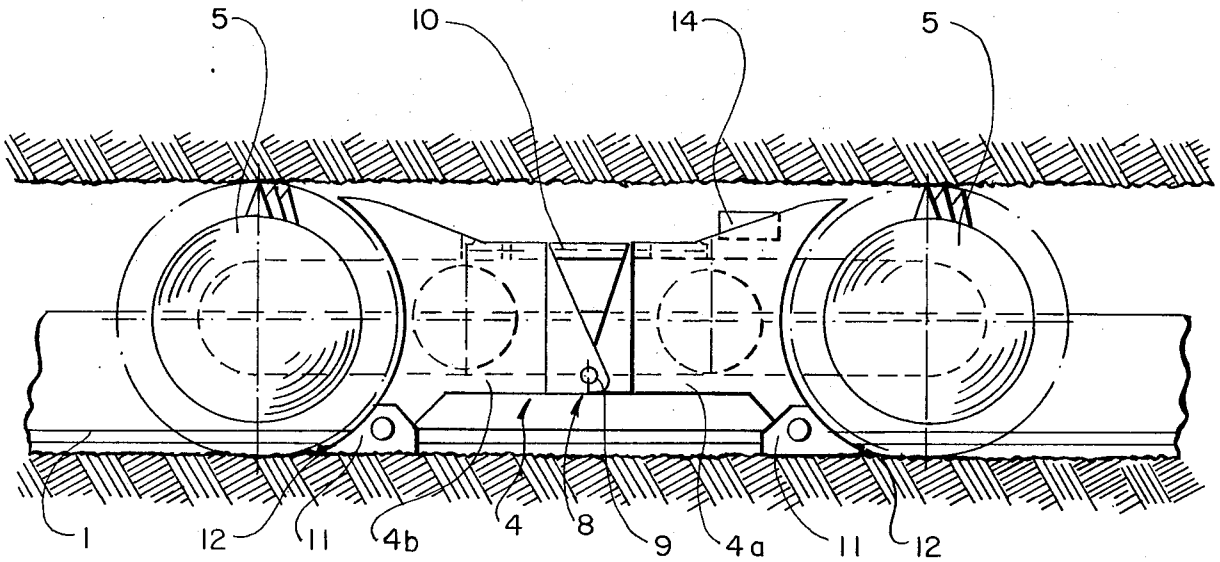
FIG. 3 is a side elevational view of the device according to FIG. 1 taken from the coal face side.

FIGS. 1 to 3 illustrate the inventive roll cutter loader which comprises a machine frame 4 guided at a plane guide 1 on a longwall conveyor 2 and pulled by a plane chain 3. The cutter loader has end side cutter rolls 5 mounted on the machine frame 4 and roll drive assemblies 6 which are merely indicated schematically and which are accommodated in the machine frame 4. The cutter rolls 5 are rotated by drives 6 and work in the region between the plane guide 1 and the working face 7 of the mine. The machine frame 4 is divided into two machine joint elements 4*a* and 4*b*, each having a cutter roll 5 and a roll drive assembly 6 of its own. The two machine joint elements 4*a*, 4*b* have a lower structural height than the cutter rolls 5 and are adjustably connected together relative to the floor, on the one hand via at least one joint 8 with horizontal joint axle 9 and on the other hand via at least one setting device 10. In the form shown, the machine joint elements 4*a*, 4*b* are connected together in the region of the floor so as to be free or above the floor underside via two identical joints 8 with joint axles 9 aligned at right angles to the forward movement direction, and in the region of their top side via the setting device 10. Each machine joint element 4*a*, 4*b* is separately connectable by a connecting member to the plane chain 3. The machine joint elements 4*a*, 4*b* are braced against the floor additionally by means of skids 11, which are mounted pivotably to the elements 3*a*, 4*b*. The skids 11 are mounted at the end of the machine joint elements 4*a*, 4*b* near the rolls 5 and are correlated to the cutter rolls 5 in shape, with a scraper edge 12 being provided at an outboard end of the frame. The plane chain 3 and the skids 11 are connected to the machine joint elements 4*a*, 4*b* in the center-of-gravity planes of the loader halves (each including a machine joint element, a roll drive assembly and a cutter roll). In this way the halves are pulled and supported near their center of gravity.

The setting device comprises a rotatable threaded spindle 10 which is driven by a drive 13 by electric motor and is connected to both machine joint elements 4*a*, 4*b* in an articulated and centered manner. By lengthening and shortening device 10, the elements 4*a*, 4*b* are made to pivot. Only one of the two machine joint elements 4*a* has a gantry 14 for an energy supply bridging the longwall conveyor 2. The gantry extends over the conveyor 2 for making connection with energy lines.

The drive assemblies 6 each may comprise a motor which is electric, hydraulic or pneumatic, mounted in the joint element and carrying a gear train which ultimately rotates a shaft on which the roll 5 is mounted. The chains 3 move over guides or sprockets 15.

While a specific embodiment of the invention has been shown and described in detail to illustrate the application of the principles of the invention, it will be understood that the invention may be embodied otherwise without departing from such principles.

What is claimed is:

1. A roll cutter loader to be guided at a plane guide on a longwall conveyor having a plane chain and extending along a working face of a mine, comprising a machine frame to be guided at the plane guide and for connection to the plane chain for movement of the machine frame in a movement direction along the plane guide, said machine frame being formed of at least two machine joint elements having a floor side and a top side, at least one joint connected between said machine joint elements at one of their floor and top sides for establishing a pivotal connection between said joint elements, and setting means connected between said joint elements at the other of their floor and top sides for setting a pivotal position between said joint elements, a cutting roll rotatably mounted to each of said joint elements, said cutting rolls being at outboard ends of said machine frame with respect to the movement direction, said joint elements having a vertical height from their floor side to their top side which is less than a vertical height of said cutting rolls, and roll drive means mounted on each joint element connected respectively to one cutting roll for rotating each cutting roll to work each cutting roll in a region between the plane guide and the working face.

2. A roll cutter loader according to claim 1, including an additional joint identical to said first mentioned joint connected between said joint elements, said first mentioned and additional joints being at the floor side of said joint elements for pivotally connecting said joint elements together, said at least one and said additional joints being identical to each other and each including an aligned joint axis extending at a right angle to said movement direction, said setting means being connected between said joint elements at said top side thereof.

3. A roll cutter loader according to claim 2, wherein each machine joint element has a connecting member connected thereto and extending outwardly therefrom for connection to the plane chain.

4. A roll cutter loader according to claim 3, including a skid pivotally mounted at the floor side of each machine joint element, each skid being positioned for supporting each machine joint element respectively.

5. A roll cutter loader according to claim 4, wherein each skid is mounted at an outboard end of each machine joint element respectively adjacent the cutter roll mounted on that joint element, each skid having an outwardly facing scraper edge with respect to the movement direction and being at least partly shaped in a manner corresponding to an outer contour of said cutting roll.

6. A roll cutter loader according to claim 5, wherein each machine joint element with its roll and its drive means comprises a loader half, each loader half having its own center of gravity plane, said connecting member and said skid of each loader half lying at the center of gravity plane thereof.

7. A roll cutter loader according to claim 6, wherein said setting means comprises a setting spindle rotatably mounted to one joint element and a drive motor engaged on said spindle and connected to the other joint element for adjusting the length of said setting means and thereby pivoting said joint elements with respect to each other.

8. A roll cutter loader according to claim 6, wherein one of said machine joint elements carries a gantry having a length for bridging the longwall conveyor and provided for supplying energy to the machine joint elements.

9. A roll cutter loader according to claim 1, wherein each machine joint element has a connecting member connected thereto and extending outwardly therefrom for connection to the plane chain.

10. A roll cutter loader according to claim 1, including a skid pivotally mounted at the floor side of each machine joint element, each skid being positioned for supporting each machine joint element respectively.

11. A roll cutter loader according to claim 10, wherein each skid is mounted at an outboard end of each machine joint element respectively adjacent the cutter roll mounted on that joint element, each skid having an outwardly facing scraper edge with respect to the movement direction and being at least partly shaped in a manner corresponding to an outer contour of said cutting roll.

12. A roll cutter loader according to claim 10, wherein each machine joint element with its roll and its drive means comprises a loader half, each loader half having its own center of gravity plane, said connecting member and said skid of each loader half lying at the center of gravity plane thereof.

13. A roll cutter loader according to claim 1, wherein said setting means comprises a setting spindle rotatably mounted to one joint element and a drive motor engaged on said spindle and connected to the other joint element for adjusting the length of said setting means the thereby pivoting said joint elements with respect to each other.

14. A roll cutter loader according to claim 1, wherein one of said machine joint elements carries a gantry having a length for bridging the longwall conveyor and provided for supplying energy to the machine joint elements.

* * * * *